US008223075B2

(12) United States Patent
Pan

(10) Patent No.: US 8,223,075 B2
(45) Date of Patent: Jul. 17, 2012

(54) MULTIBAND ANTENNA

(75) Inventor: Jun-Liang Pan, Tu-Cheng (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 465 days.

(21) Appl. No.: 12/503,735

(22) Filed: Jul. 15, 2009

(65) Prior Publication Data

US 2010/0026585 A1 Feb. 4, 2010

(30) Foreign Application Priority Data

Jul. 30, 2008 (CN) ..... 2008 1 0303208

(51) Int. Cl.
*H01Q 5/00* (2006.01)

(52) U.S. Cl. ..... 343/700 MS; 343/702; 343/845; 343/846; 343/872

(58) Field of Classification Search ..... 343/700 MS, 343/702, 845–846, 872
See application file for complete search history.

(56) References Cited

U.S. PATENT DOCUMENTS

| | | | | |
|---|---|---|---|---|
| 6,734,825 | B1 * | 5/2004 | Guo et al. | 343/700 MS |
| 6,982,675 | B2 * | 1/2006 | Kwak et al. | 343/702 |
| 7,119,748 | B2 * | 10/2006 | Autti | 343/702 |
| 7,161,541 | B2 * | 1/2007 | Chen | 343/700 MS |
| 7,256,743 | B2 * | 8/2007 | Korva | 343/702 |
| 7,439,916 | B2 * | 10/2008 | Wang et al. | 343/700 MS |
| 7,489,278 | B2 * | 2/2009 | Huang | 343/702 |
| 7,696,932 | B2 * | 4/2010 | Desclos et al. | 343/702 |
| 7,768,460 | B2 * | 8/2010 | Yang et al. | 343/700 MS |

* cited by examiner

*Primary Examiner* — Jacob Y Choi
*Assistant Examiner* — Shawn Buchanan
(74) *Attorney, Agent, or Firm* — Altis Law Group, Inc.

(57) ABSTRACT

A multiband antenna includes a base board, a feed member, a first grounding connector, a second grounding connector, a first radio member, a second radio member, a third radio member and a fourth radio member. The feed member, the first grounding connector and the second grounding connector are all electronically connected to the base board. The first radio member is electronically connected to the feed member and the first grounding connector. The second radio member is electronically connected to the first radio member. The third radio member is electronically connected to the first radio member. The fourth radio member is electronically connected to the second grounding connector. In use, the multiband antenna sends/receives wireless signals in different working frequencies by the radio members.

14 Claims, 3 Drawing Sheets

MULTIBAND ANTENNA

BACKGROUND

1. Technical Field

The present disclosure relates to multiband antennas, and particularly to a multiband antenna used in portable electronic devices.

2. Description of Related Art

Nowadays, portable electronic devices, such as mobile phones, personal digital assistants (PDA) and laptop computers, are widely used. Most of these portable electronic devices have antennas mounted therein for receiving/sending wireless signals. Commonly, a portable electronic device may receive/send wireless signals of different frequencies, which requires its antenna be a multiband antenna.

However, many multiband antennas have complicated structures and are large in size, making it difficult to miniaturize portable electronic devices. Even if some miniaturized multiband antennas can be installed in the portable electronic devices, they are difficult to be installed precisely. Thus, communication quality of the portable electronic devices may be adversely affected.

Therefore, there is room for improvement within the art.

BRIEF DESCRIPTION OF THE DRAWINGS

Many aspects of the present multiband antenna can be better understood with reference to the following drawings. The components in the various drawings are not necessarily drawn to scale, the emphasis instead being placed upon clearly illustrating the principles of the present multiband antenna. Moreover, in the drawings, like reference numerals designate corresponding parts throughout the figures.

DETAILED DESCRIPTION

Figure 1:
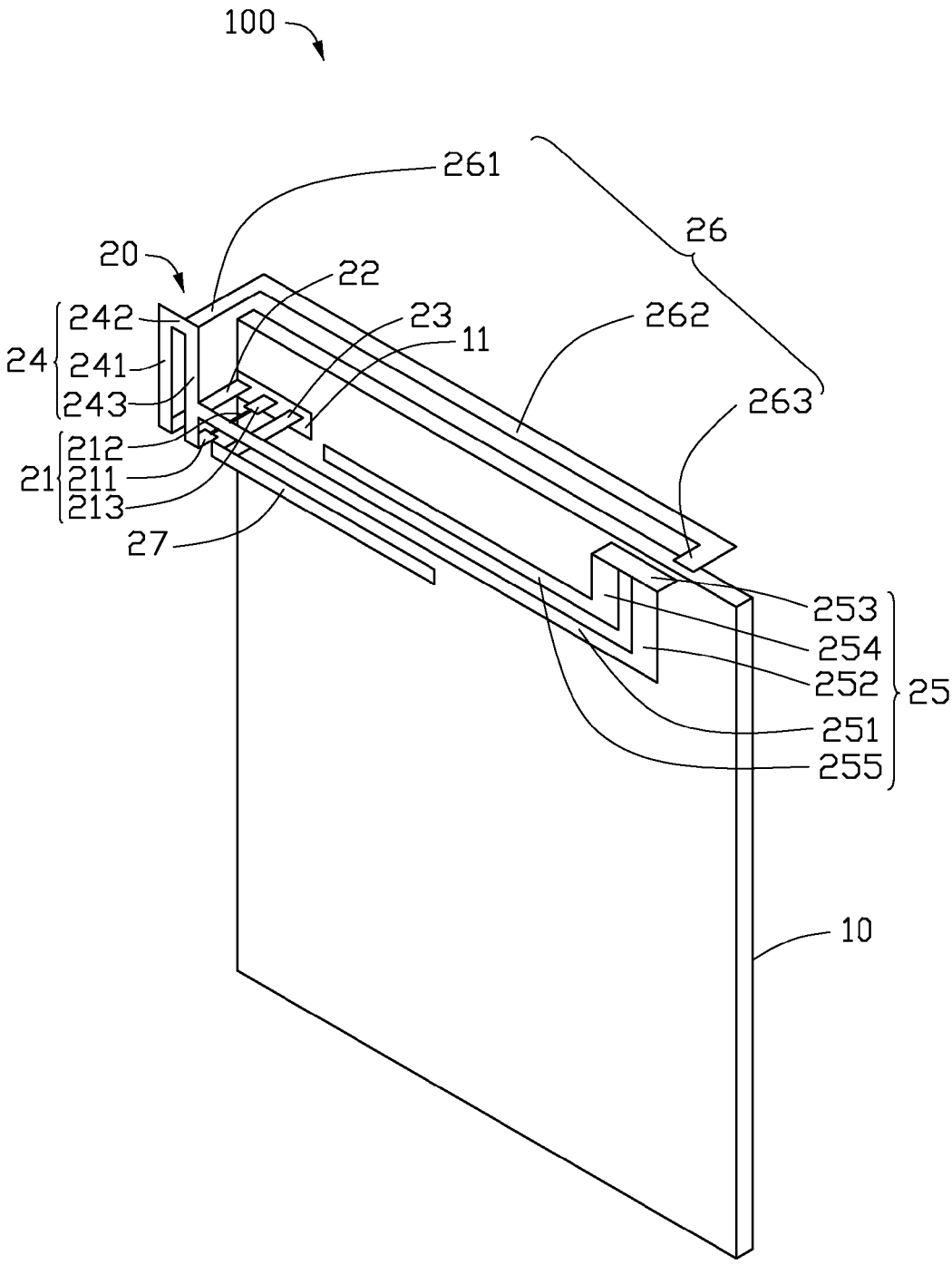
FIG. 1 is a schematic view of a multiband antenna, according to an exemplary embodiment.
Figure 2:
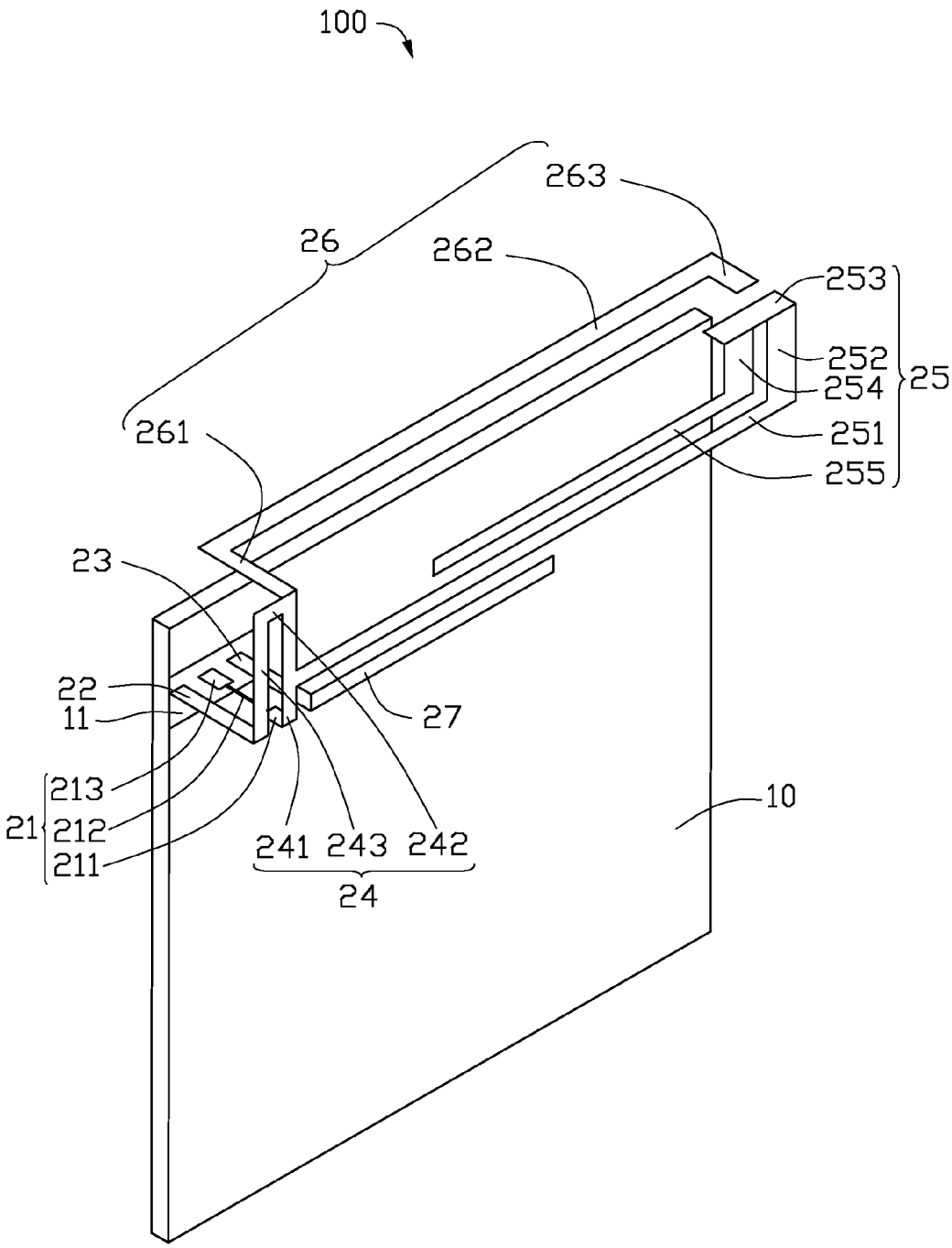
FIG. 2 is a schematic view of the multiband antenna shown in FIG. 1, shown in another view angle.

FIG. 1 and FIG. 2 schematically show a multiband antenna 100 according to an exemplary embodiment, for use in portable electronic devices. The multiband antenna 100 includes a base board 10 and a radio unit 20.

The base board 10 is a planar board, which can be a part of a printed circuit board (PCB) in a portable electronic device. The base board 10 includes a planar connecting area 11 made of conductive materials (e.g., metals or conductive inks) for electronic connection to the radio unit 20.

The radio unit 20 is made of conductive materials, such as metal. The radio unit 20 includes a feed member 21, a first grounding connector 22, a second grounding connector 23, a first radio member 24, a second radio member 25, a third radio member 26, and a fourth radio member 27. The first radio member 24, the second radio member 25, the third radio member 26, and the fourth radio member 27 can be respectively used to receive/send wireless signals having different working frequencies.

The feed member 21 includes a first connecting component 211, a feed line 212 and a second connecting component 213. The first connecting component 211 and the second connecting component 213 are both rectangular sheets having a length of about 1.5 mm and a width of about 1 mm. The feed line 212 is a wire connecting the second connecting component 213 to the first connecting component 211, and the first connecting component 211, the feed line 212 and the second connecting component 213 are all positioned in a same plane perpendicular to the base board 10. An end of the second connecting component 213 is perpendicularly connected to the connecting area 11, such that the second connecting component 213, the feed line 212, and the first connecting component 211 perpendicularly extend from the base board 10.

The first grounding connector 22 and the second grounding connector 23 are both longitudinal sheets having a length of about 6 mm and a width of about 1 mm. The first grounding connector 22 and the second grounding connector 23 are both perpendicularly connected to the connecting area 11 and perpendicularly extend from the base board 10. The feed member 21 is positioned between the first grounding connector 22 and the second grounding connector 23, and is coplanar with the first grounding connector 22 and the second grounding connector 23. The distances between the feed member 21 and the first grounding connector 21/the second grounding connector 23 are both about 1 mm.

The first radio member 24 is a U-shaped sheet including two arm sheets 241, 243 and a connecting sheet 242. The arm sheets 241, 243 and the connecting sheet 242 are all positioned in a same plane that is parallel to the base board 10. The arm sheets 241, 243 are both longitudinal sheets having a length of about 8 mm and a width of about 1 mm, and the connecting sheet 242 is a rectangular sheet having a length of about 1 mm and a width of about 1 mm. The arm sheet 241 has one end perpendicularly connected to the distal end of the first grounding connector 22 and another end connected to the connecting sheet 242, and the arm sheet 243 has one end perpendicularly connected to the distal end of the second grounding connector 23 and another end connected to the connecting sheet 242. The arm sheets 241, 243 are positioned to extend parallel to each other, and a distance between the two arm sheets 241, 243 is about 1 mm.

The second radio member 25 includes a first section 251, a second section 252, a third section 253, a fourth section 254 and a fifth section 255. The first section 251, the second section 252, the fourth section 254 and the fifth section 255 are all sheets positioned coplanar with the first radio member 24, and the third section 253 is a sheet positioned in a plane parallel to the plane where the feed member 21 is positioned.

Particularly, the first section 251 is a longitudinal sheet having a length of about 35 mm and a width of about 1 mm, which is perpendicularly connected to the out side edge of the arm sheet 243 and extends parallel to the base board 10. The second section 252 is a rectangular sheet having a length of about 5 mm and a width of about 2 mm, which is perpendicularly connected to a distal end of the first section 251 and extends parallel to the arm sheet 243 and the base board 10, and a distal end of the second section 252 is positioned collinear to the out side edge of the connecting sheet 242. The third section 253 is a rectangular sheet having a length of about 5 mm and a width of about 1.5 mm, which is positioned perpendicular to the base board 10. The fourth section 254 is a rectangular sheet having a length of about 3 mm and a width of about 2 mm, which extends parallel to the second section 252, and a distance between the fourth section 254 and the second section 252 is about 1 mm. Similar to the second section 252, the fourth section 254 has an end positioned collinear to the out side edge of the connecting sheet 242. The ends of the second section 252 and the fourth section 254 are collinear to the out side edge of the connecting sheet 242 are both perpendicularly connected to a same side of the third section 253, thus the third section 253 is aligned with the out side edge of the connecting sheet 242. The fifth section 255 is a longitudinal sheet having a length of about 22.4 mm and a width of about 1 mm, which is perpendicularly connected to another end of the fourth section 254 and extends parallel to the first section 251 towards the first radio member 24. A distance between the first section 251 and the fifth section 255 is about 1 mm.

The third radio member 26 includes a connecting portion 261, a main portion 262, and an extending portion 263, which are all sheets positioned coplanar with the third section 253. The connecting portion 261 is a rectangular sheet having a length of about 6 mm and a width of about 1 mm, which is perpendicularly connected to the out side edge of the connecting sheet 242 and extends towards the base board 10. The main portion 262 is a longitudinal sheet having a length of about 35 mm and a width of about 1.3 mm, which is perpendicularly connected to the distal end of the connecting portion 261 and extends parallel to the first section 251 and the fifth section 255. The extending portion is a rectangular sheet having a length of about 3.5 mm and a width of about 1.3 mm, which is perpendicularly connected to the distal end of the main portion 262 and extends towards the second radio member 25. Thus, the third radio member 26 is configured to be approximately U-shaped.

The fourth radio member 27 is a longitudinal sheet having a length of about 17 mm and a width of about 2 mm. An end of the fourth radio member 27 is perpendicularly connected to the distal end of the second grounding connector 23. The fourth radio member 27 is positioned coplanar with the first radio member 24 and extends parallel to the first section 251, and a distance between the fourth radio member 27 and the first section 251 is about 1 mm.

The multiband antenna 100 can be used in portable electronic devices, such as mobile phones, personal digital assistants (PDA), or laptop computers. In use, the connecting area 11 is connected to inner circuits (not shown) of a portable electronic device, thus the multiband antenna 100 can be grounded by the first grounding connector 22 and the second grounding connector 23, and be provided with feed signals by the feed member 21.

When feed signals are input to the multiband antenna 100 from the feed member 21 and respectively travelling through the first radio member 24, the second radio member 25, the third radio member 26 and the fourth radio member 27, the first radio member 24, the second radio member 25, the third radio member 26 and the fourth radio member 27 can respectively generate different resonating frequencies. Thus, the multiband antenna 100 can be used in wireless communication systems having different working frequencies. Particularly, the first radio member 24 can cooperate with the second radio member 25 to generate a resonating frequency of about 830 MHz, the third radio member 26 can generate a resonating frequency of about 925 MHz, the second radio member 25 can independently generate a resonating frequency of about 1750 MHz, and the fourth radio member 27 can generate a resonating frequency of about 1930 MHz. Therefore, the multiband antenna 100 can send/receive wireless communication signals in at least four above-mentioned frequencies, and thus the multiband antenna 100 can be used in wireless communication systems having different working frequencies, such as GSM 850 (Global System for Mobile communication, 824-894 MHz), GSM900 (880-960 MHz), DCS1800 (Digital Communication System, 1710-1880 MHz), and PCS1900 (Personal Communication Services, 1850-1990 MHz), etc.

Figure 3:
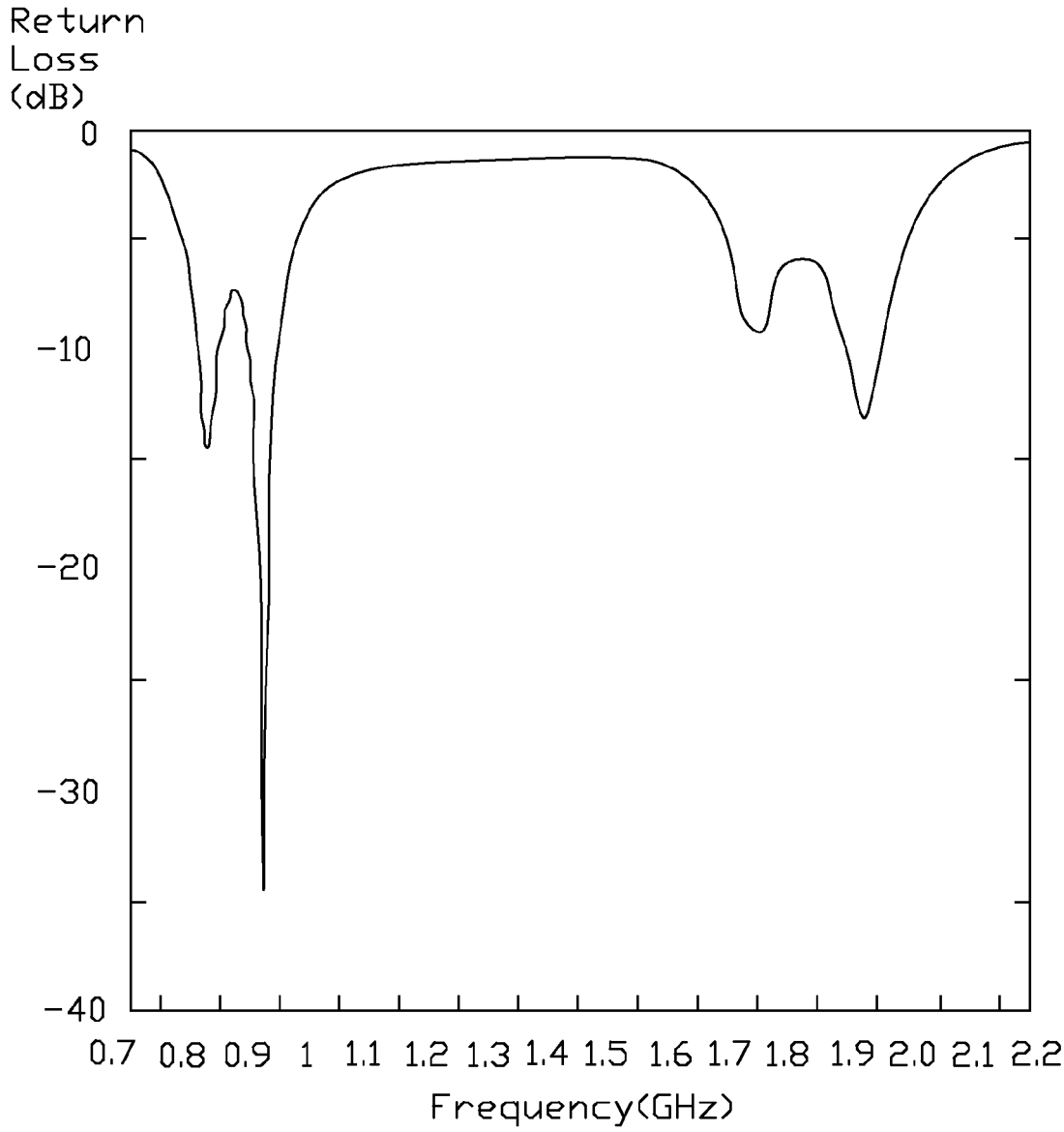
FIG. 3 is a diagram of measuring a return loss (RL) of the multiband antenna shown in FIG. 1, in different working frequencies.

Referring to FIG. 3, shows that when the multiband antenna 100 is respectively used to receive/send wireless communication signals in 824 MHz, 960 MHz, 1710 MHz and 1900 MHz, the return loss of the multiband antenna 100 are correspondingly −13.14 dB, −7.17 dB, −6.5 dB and −5.75 dB. In the four above-mentioned frequency bands, the multiband antenna 100 is applicable in wireless communication.

The outer dimensions of the multiband antenna are about 8 mm×38 mm×6 mm. When the multiband antenna 100 is installed in a portable electronic device, the base board 10 can be integrated with a conventional circuit board of the portable electronic device, and thus the multiband antenna 100 does not occupy much space. As above-mentioned, the multiband antenna 100 is small in size and has good communication quality in at least four frequency bands, which can allow further reductions in sizes of portable electronic devices employing the multiband antenna 100. Note that the dimensions set forth herein are exemplary of the working frequencies also mentioned herein. Accordingly, the dimensions of the multiband antenna 100 are not limited to the dimensions set forth in this application.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A multiband antenna, comprising:

a base board;

a feed member electronically connected to the base board and positioned in a plane;

a first grounding connector electronically connected to the base board;

a second grounding connector electronically connected to the base board;

a first radio member electronically connected to the feed member and the first grounding connector;

a second radio member electronically connected to the first radio member;

a third radio member electronically connected to the first radio member, the third radio member including a connecting portion, a main portion and an extending portion connected orderly, the connecting portion, the main portion and the extending portion are all sheets positioned in a same plane which is perpendicular to the plane in which the feed member is positioned; and a fourth radio member electronically connected to the second grounding connector; wherein the first radio member cooperate with the second radio member to send/receive wireless signals having a first working frequency, the second radio member independently sends/receives wireless signals having a second working frequency, the third radio member sends/receives wireless signals having a third working frequency, and the fourth radio member sends/receives wireless signals in a fourth working frequency.

2. The multiband antenna as claimed in claim 1, wherein the base board includes a planar connecting area, and the feed member, the first grounding connector and the second grounding connector are all electronically connected to the connecting area.

3. The multiband antenna as claimed in claim 2, wherein the plane in which the feed member is positioned is perpendicular to the base board, and the feed member includes a first connecting component, a feed line and a second connecting component, the first connecting component and the second connecting component are both sheets and an end of the second connecting component is connected to the connecting area, and the feed line is a wire connecting the second connecting component to the first connecting component.

4. The multiband antenna as claimed in claim 3, wherein the first grounding connector and the second grounding connector are both longitudinal sheets positioned coplanar with the feed member.

5. The multiband antenna as claimed in claim 1, wherein the first radio member includes two parallel longitudinal arm sheets and a connecting sheet positioned in a same plane parallel to the base board, the two arm sheets are respectively connected to the first grounding connector and the feed member, and are connected to each other by the connecting sheet.

6. The multiband antenna as claimed in claim 5, wherein the second radio member includes a first section, a second section, a third section, a fourth section and a fifth section connected; the first section, the second section, the fourth section and the fifth section are all sheets positioned coplanar with the first radio member, and the third section is a sheet positioned in a plane parallel to the plane of the feed member.

7. The multiband antenna as claimed in claim 6, wherein the first section is connected to the arm sheet that is connected to the first feed member.

8. The multiband antenna as claimed in claim 7, wherein the first section is a longitudinal sheet perpendicularly connected to the arm, the second section is a rectangular sheet perpendicularly connected to a distal end of the first section, the fourth section is a rectangular sheet extending parallel to the second section and the fifth section is a longitudinal sheet extending parallel to the first section.

9. The multiband antenna as claimed in claim 8, wherein the connecting portion is a rectangular sheet connected to the connecting sheet and extends towards the base board, the main portion is a longitudinal sheet connected to the distal end of the connecting portion and extends parallel to the first section, and the extending portion is connected to the distal end of the main portion and extends towards the second radio member.

10. The multiband antenna as claimed in claim 8, wherein the fourth radio member is a longitudinal sheet connected to the second grounding connector, positioned coplanar with the first radio member and extending parallel to the first section.

11. The multiband antenna as claimed in claim 1, wherein the first working frequency is a working frequency band of GSM850 communication systems.

12. The multiband antenna as claimed in claim 1, wherein the second working frequency is a working frequency band of DCS1800 communication systems.

13. The multiband antenna as claimed in claim 1, wherein the third working frequency is a working frequency band of GSM900 communication systems.

14. The multiband antenna as claimed in claim 1, wherein the fourth working frequency is a working frequency band of PCS1900 communication systems.

* * * * *